US005653137A

United States Patent [19]

Takakura et al.

[11] Patent Number: 5,653,137

[45] Date of Patent: Aug. 5, 1997

[54] FIVE-HIGH ROLLING MILL

[75] Inventors: Yoshio Takakura; Toshiyuki Kajiwara, both of Hitachi, Japan

[73] Assignee: Hitachi, Ltd., Tokyo, Japan

[21] Appl. No.: 375,274

[22] Filed: Jan. 19, 1995

Related U.S. Application Data

[63] Continuation of Ser. No. 1,196, Jan. 7, 1993, abandoned, which is a continuation-in-part of Ser. No. 829,579, Feb. 3, 1992, Pat. No. 5,239,851.

[30] Foreign Application Priority Data

May 31, 1989 [JP] Japan ..... 1-136052
Sep. 20, 1989 [JP] Japan ..... 1-242162

[51] Int. Cl.[6] ..... B21B 37/16

[52] U.S. Cl. ..... 72/11.8; 72/241.8; 72/245

[58] Field of Search ..... 72/241.2, 241.8, 72/245, 11.6, 11.7, 11.8, 11.9

[56] References Cited

U.S. PATENT DOCUMENTS

| | | | |
|---|---|---|---|
| 3,334,506 | 8/1967 | Hicks | 72/245 |
| 3,818,743 | 6/1974 | Kajiwara et al. | 72/245 |
| 3,857,268 | 12/1974 | Kajiwaka | 72/247 |
| 3,875,776 | 4/1975 | Morooka | 72/11 |
| 4,194,382 | 3/1980 | Kajiwara | 72/243.2 |
| 4,311,030 | 1/1982 | Kitashima et al. | 72/8 |
| 4,369,646 | 1/1983 | Kajiwara | 72/243.2 |
| 4,458,515 | 7/1984 | Imai | 72/20 |
| 4,539,833 | 9/1985 | Kato et al. | 72/243.2 |
| 4,587,819 | 5/1986 | Hausen | 72/9 |
| 4,718,262 | 1/1988 | Fapiano | 72/6 |
| 4,726,213 | 2/1988 | Manchu | 72/366.2 |
| 4,805,492 | 2/1989 | Tsuruda | 72/8 |

FOREIGN PATENT DOCUMENTS

| | | |
|---|---|---|
| 54-39349 | 3/1979 | Japan . |
| 54-121263 | 9/1979 | Japan . |
| 56-151103 | 11/1981 | Japan . |
| 56-154206 | 11/1981 | Japan . |
| 60-141310 | 7/1985 | Japan . |
| 2-18313 | 1/1990 | Japan . |

OTHER PUBLICATIONS

*Iron and Steel Engineer*, "Behavior of Rolls in 6–h Mills", J.W. Turley, vol. 62, No. 3, Mar. 1985.

*Steel Rolling Technology*, Vladimir B. Ginzburg, pp. 762–776, 1989.

*Primary Examiner*—Lowell A. Larson
*Assistant Examiner*—Thomas C. Schoeffler
*Attorney, Agent, or Firm*—Evenson McKeown Edwards & Lenahan, PLLC

[57] ABSTRACT

A multi-high rolling mill is disclosed which includes an upper work roll backed by an intermediate roll and a backup roll and a lower work roll backed up by a single backup roll. Control benders are provided on each of the intermediate roll and the upper and lower work rolls. In order to optimize the control of the rolling operation for skinpass rolling and the like, the control benders for the upper work roll and the intermediate backup roll are controlled so as to effect a control of the crown sheet over the entire width of the material being rolled, while the control bender for the lower work roll controls the sheet crown of the rolled material at the lateral side end portions, resulting in a composite control substantially improving the sheet quality and preventing edge wrinkles in the material being rolled. In the disclosed embodiments, the intermediate roll has a larger drum length than a predetermined maximum sheet width of rolled material to be rolled by the work roll. The shape of sheet material is sensed by a shape detector which provides a signal to a controller which actuates the roll benders.

28 Claims, 9 Drawing Sheets

FIVE-HIGH ROLLING MILL

This application is a continuation of application Ser. No. 08/001,196, filed on Jan. 7, 1993, now abandoned, which is a continuation-in-part of application Ser. No. 07/829,579 filed on Feb. 3, 1992, now U.S. Pat. No. 5,239,851.

BACKGROUND AND SUMMARY OF THE INVENTION

The present invention relates to a multi-high rolling mill whose sections above and below a rolled material have different numbers of rolls and, more particularly, to a five-high rolling mill, a multi-high rolling mill, and a skinpass rolling mill which are suitable for skinpass rolling or rolling of aluminum.

In general, as a rolling mill of a small rolling reduction and a small rolling force, e.g., a skinpass rolling mill, there has conventionally been often employed a four-high rolling mill which includes upper and lower work rolls provided with bending devices and upper and lower backup rolls supporting these work rolls, as disclosed in Japanese Patent Unexamined Publication No. 48-22344.

However, such a four-high rolling mill does not have a sufficient ability in shape control, and insufficiency of this ability is compensated with various work rolls provided with different crowns. That is why a six-high rolling mill which is superior in the shape control ability has been suggested and applied to practical use (see Japanese Patent Examined Publication No. 57-55484). This six-high rolling mill is arranged in such a manner that upper and lower intermediate rolls are disposed between upper and lower work rolls of the same diameter and upper and lower backup rolls of the same diameter, respectively, and that roll bending devices are installed on the upper and lower work rolls and the upper and lower intermediate rolls, both sets of these bending devices being capable of providing a great ability in the shape control. In the case of skinpass rolling with a small rolling reduction, this six-high rolling mill causes portions of the side ends of a rolling stock to remain non-rolled so that edge wrinkles are formed on the side ends of the rolling stock, thereby resulting in a problem that formation of such edge wrinkles cannot be adequately prevented.

A conventional multi-high rolling mill whose sections above and below a rolling stock have different numbers of rolls or a conventional five-high rolling mill in particular is disclosed in each of Japanese Patent Examined Publication Nos. 60-48242 and 62-46245. Such a five-high rolling mill includes upper and lower work rolls of different diameters, with the upper work roll being a roll of the smaller diameter, and thus, a large rolling reduction can be obtained from a small rolling force. Further, bending devices are installed on both the intermediate roll and the lower work roll of the larger diameter so as to cause the five-high rolling mill to exhibit its ability in controlling a sheet crown. Hence it is possible to control a simply curved (concaved or convex) crown of the rolling stock in its entire width, decrease the rolling force, and enhance the effect of the benders as a result.

On the contrary, in case of i) a rolling operation with both the rolling reduction and the rolling force having small values, ii) a rolling operation which requires an excellent ability in the sheet surface control enabling composite shape control, and iii) a rolling operation which requires prevention of the edge wrinkles, for example, in case of skinpass rolling, rough-surface dull rolls, that is, work rolls in the above-mentioned five-high rolling mill including the upper and lower work rolls of different diameters are extremely shortened in life, and the rolled material is apt to be unfavorably warped. Besides, if the work rolls have small diameters, another problem is caused in that a cross buckle or a folding is apt to be generated during the rolling operation.

A five-high rolling mill including an intermediate roll which has the same drum length as the width of the rolled strip sheet, in which upper and lower work rolls of the same diameter are provided with bending devices, is disclosed in each of Japanese Patent Unexamined Publication No. 54-39349 and Japanese Patent Examined Publication No. 53-34789.

In the use of such five-high rolling mills, it is necessary to replace the intermediate roll with a new one every time the sheet width of the rolled strip sheet is changed, and the rolling operation must be stopped on each such occasion, so that the productivity of the rolling mill will be lowered to a great extent, and the rolling mill will fail to be practical in use. Especially in the case of a skinpass rolling mill installed in a continuous annealing line, since a rolling stock of different widths are continuously supplied thereto, the above-mentioned five-high rolling mill is quite unlikely to be applied to practical use.

Further, five-high rolling mills in which upper and lower work rolls are of the same diameter and these upper and lower work rolls and an intermediate roll of a diameter smaller than that of the work rolls are respectively provided with bending devices as disclosed in Japanese Patent Unexamined Publication No. 56-151103. However, the intermediate roll of such a five-high rolling mill which has a small diameter and the same drum length as that of the backup roll and the work roll, is in contact with the backup roll and the work roll over its entire length, and therefore, the control characteristic of the intermediate roll becomes similar to that of the upper work roll, thereby resulting in a problem that it is basically impossible to accomplish either the composite shape control or the control for prevention of the edge wrinkles.

Although the conventional rolling mills described above are all intended to improve the abilities in shape correction, they cannot satisfactorily perform the skinpass rolling operation in which the rolling reduction and the rolling force are both small and it is necessary to obtain an excellent quality of the surface. More particularly, examples of characteristics of the skinpass rolling operation can be expressed as follows:

i) The rolling reduction is not more than several percent, and the rolling force is not more than half the force of normal cold rolling.

ii) A rough-surface dull roll is often used as a work roll so that the surface of the product will be pear-skinned.

iii) When the side end portions of the stock remain non-rolled, irregularities (edge wrinkles) of the surface are formed thereon due to the stretcher strain, and this is because the rolled stock has been annealed in advance.

iv) Since the stock after the skinpass rolling often becomes a finished product as it is, the product is required to have an excellent surface quality.

Referring to these characteristics, requirements of a skinpass rolling mill will be reviewed.

First, as for the diameters of work rolls, the rolls are required to have relatively large diameters in order to prevent the cross buckle or folding in the skinpass rolling operation. Also, it is desirable for upper and lower work rolls to have the same diameter (practically the same diameter) in terms of lives of dullness of the work rolls and prevention of warping of a strip sheet after the skinpass rolling process.

As for the shape control of the rolling material to obtain a strip sheet of excellent surface quality, it is necessary for the rolling mill to have an ability in composite shape control for correcting both edge wrinkling and center buckling.

Lastly, it is very important to reduce the widths of the non-rolled side end portions of the strip sheet where edge wrinkles are formed. Since these portions having edge wrinkles are to be cut off as defective parts in the following process, reduction of the widths of the wrinkled portions serves to improve the yield efficiently.

The characteristics of a rolling mill suitable for the skinpass rolling operation can be summarized as follows:

1) Work rolls are practically of the same diameter and also of a relatively large diameter.
2) In order to perform composite shape control for providing excellent surface quality, two kinds of control means of different control characteristics are necessary.
3) Third control means other than those means for the composite shape control are required for reducing the edge wrinkles of the strip sheet.

An object of the present invention is to provide a five-high rolling mill by which material can be rolled into a strip sheet having an excellent surface quality even under the conditions of a small rolling reduction and a small rolling force and also formation of edge wrinkles on the side end portions of the strip sheet can be prevented.

Another object of the present invention is to provide a multi-high rolling mill by which formation of such defects as a cross buckle can be prevented during the rolling operation of a small rolling reduction, the ability in the composite shape control of the rolled material can be fully exercised, and also formation of any edge wrinkles on the side end portions of the strip sheet can be prevented.

A still further object of the present invention is to provide a skinpass rolling mill of a compact structure by which stock can be rolled into a strip sheet having an excellent surface quality and also formation of any edge wrinkles on the side end portions of the strip sheet can be prevented.

A further object of the present invention is to provide a rolling method in the multi-high rolling mill by which the ability of the composite shape control of the rolled material can be fully exhibited during the rolling operation of a small rolling reduction and also formation of any edge wrinkles on the side end portions of the strip sheet can be prevented.

In order to attain the above-stated objects, the present invention provides a five-high rolling mill including an intermediate roll which has a diameter larger than upper and lower work rolls of substantially the same diameter and smaller than upper and lower backup rolls, wherein the intermediate roll is formed to have a larger drum length than the maximum width of a rolled material, first roll bending devices are respectively installed on the roll ends of the upper and lower work rolls, while second roll bending devices are installed on the roll ends of the intermediate roll, and the shape of sheet material rolled through the mill is sensed by a shape detector which provides a signal to a controller for actuating the roll bending devices.

In an aspect of the present invention it is preferable to improve the roll bending effects so as to obtain a strip sheet of a more excellent surface quality by providing that the backup roll directly supporting the intermediate roll is in contact with the intermediate roll over a distance smaller than the drum length of the intermediate roll, or by providing that the backup roll directly supporting the intermediate roll is in contact with the intermediate roll over a distance larger than the minimum width of the rolled material and smaller than the maximum width of the same, or that by providing bending devices of the intermediate roll and bending devices on the work roll supported by the intermediate roll that are at least equipped with an increase bender mechanism, while bending devices of the work roll directly supported by the backup roll are at least equipped with a decrease bender mechanism.

The present invention also provides a multi-high rolling mill including a certain number of supporting rolls and a different number of supporting rolls which support upper and lower work rolls of substantially the same diameter so that sections of the rolling mill above and below a rolled material have sets of the rolls in different numerals. In the rolling mill, roll bending devices are installed on the supporting roll directly supporting the work roll in the roll set of the larger number of the rolls, so as to arrange the upper and lower roll sets to have different control degrees, each indicating an amount of change in a sheet crown of the strip sheet which can be controlled by the roll bending devices, while roll bending devices are installed on the respective work rolls in the upper and lower roll sets, in order to differ the control degrees of the sheet crown which can be controlled by the respective roll bending devices for the upper and lower work rolls, and thus, the supporting roll in the one roll set of the larger number of the rolls, the work roll in the same roll set, and the work roll in the other roll set of the smaller number of the rolls are controlled with the control degrees of values gradually increasing in this order.

Moreover, the present invention provides a skinpass rolling mill including an intermediate roll between one of the upper and lower work rolls of substantially the same and large diameter and the associated one of upper and lower backup rolls, wherein the intermediate roll has a drum length larger than the maximum width of a rolled material and smaller than the drum length of the work roll, and roll bending devices are installed on the roll ends of the intermediate roll, while roll bending devices are respectively installed on the roll ends of the upper and lower work rolls, the roll bending devices of the lower work roll being at least equipped with a decrease bender mechanism.

Furthermore, the present invention provides a rolling method in a multi-high rolling mill including upper and lower work rolls of substantially the same diameter, upper and lower backup rolls respectively supporting these work rolls, and an intermediate roll located between one of the upper and lower work rolls and the associated backup roll. In this rolling method applied to the multi-high rolling mill, roll bending devices installed on the intermediate roll and roll bending devices installed on the work roll in the roll set where this intermediate roll is disposed are all actuated to control a composite crown of a strip sheet over its entire width, and roll bending devices installed on the work roll directly supported by the backup roll are actuated to control the crown of the strip sheet in its side end portions, thereby performing both of the composite shape control of the strip sheet and the control of the widths of the side end portions of the strip sheet which are not to be rolled.

BRIEF DESCRIPTION OF THE DRAWINGS

FIG. 13 schmetically shows a relationship between bender force and widths of non-rolled side ends.

DETAILED DESCRIPTION OF THE DRAWINGS

The principle of a rolling mill according to the present invention will now be explained.

The present invention provides a multi-high rolling mill which has an excellent ability for composite shape control for accomplishing improvement of the surface quality of strip sheet so that edge wrinkles can be prevented from forming on the side ends of the strip sheet. For this purpose, the rolling mill of the present invention includes an intermediate roll disposed between one of upper and lower work rolls having substantially the same diameter and a backup roll, the drum length of the intermediate roll being formed to be larger than an extent of the maximum width of the strip sheet, and the upper and lower work rolls and the intermediate roll are respectively provided with roll bending devices which have different control characteristics for moderating a crown shape of the strip sheet.

According to the present invention, the composite shape control of strip sheet is mainly performed by the intermediate roll bender and the work roll bender on one side where the intermediate roll is disposed, so as to improve the surface quality of the strip sheet, and the widths of the side end portions of the strip sheet which have not been rolled are controlled by the work roll bender on the other side where the intermediate roll is not disposed, so as to remarkably reduce the non-rolled side end portions of the strip sheet, thereby preventing formation of edge wrinkles.

Figure 8:
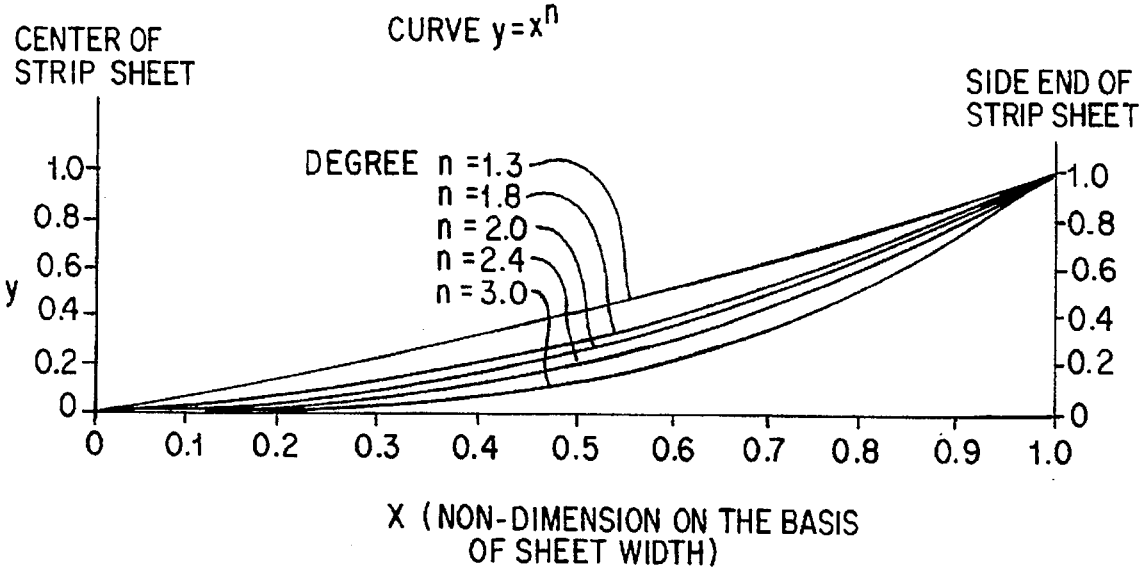
FIG. 8 is a diagram showing curves of values of x to certain powers.

The shape controlling ability of a roll bender can be expressed numerically as a control degree. Referring to FIG. 8, the equation shown therein, $y=x^n$, describes the amount of deflection of the roll, y, as a function of the distance from the center of the sheet, x. The exponential term, n, is the control degree.

The rolling mill of the present invention is provided with the roll benders of three kinds, i.e., the intermediate roll bender, the work roll bender on the side where the intermediate roll is disposed (hereinafter referred to as the 6H-side), and the work roll bender on the side where the intermediate roll is not disposed (hereinafter referred to as the 4H-side). These roll benders have such shape control degrees as to vary the respective characteristics for controlling the crown of the rolled strip sheet from one another, and thus, not only the composite shape but also the widths of the side end portions having edge wrinkles can be controlled. In case of a five-high rolling mill, for example, having roll sizes representative of a skinpass rolling mill where the work roll is 475 mm in diameter; the intermediate roll is 530 mm in diameter; the backup roll is 1000 mm in diameter; and the rolling surface of each roll is 2050 mm long with a sheet width of 1880 mm, calculation results of control degrees of the respective benders are shown in Table 1. In this case, a control degree expresses a change of crown of rolled strip sheet which can be controlled by the roll bending devices.

TABLE 1

Control degrees by roll bending

| Case | 4H-side work roll | 6H-side Work Roll | 6H-side Intermediate Roll | Control degree |
|---|---|---|---|---|
| 1 | 0 | — | — | 2.8 |
| 2 | — | 0 | — | 2.2 |
| 3 | — | — | 0 | 1.8 |
| 4 | 0 | 0 | — | 2.4 |

In Table 1, Case 1 indicates a control degree when only the roll bender for the 4H-side work roll directly supported by the backup roll is actuated, and this control degree generally has a value from 2.6 to 3.3. Case 2 indicates a control degree when only the roll bender for the 6H-side work roll supported by the intermediate roll is actuated, and this control degree generally has a value from 2.0 to 2.5. Case 3 indicates a control degree when only the roll bender for the intermediate roll is actuated, and this control degree generally has a value from 1.7 to 1.9. Further, Case 4 indicates a control degree when both of the above-mentioned roll benders for the 4H-side and 6H-side work rolls are actuated.

As shown above in Table 1, it is difficult to offer the effect of the 4H-side work roll bender of the five-high rolling mill onto the center of the rolled strip sheet because the associated work roll is in contact with the backup roll of an extremely high flexural rigidity over the entire length, thus resulting in a high control degree. On the other hand, the effect of the 6H-side work roll bender is readily produced at the center of the strip sheet because the associated work roll is in contact with the intermediate roll, and the control degree is lower than that of the 4H-side bender. The intermediate roll bender tends to produce the effect essentially at the center of the strip sheet, and therefore, the control degree has the smallest value.

As disturbances for shape in the skinpass rolling process, there are a change of rolling force, a change of the sheet crown, and a change of a thermal crown of work rolls. Changes of the rolling force and the sheet crown are depicted with substantially the same curve of the second degree, and the thermal crown in case of the skinpass rolling process is changed as time elapses, depicting a curve of the 1.8 to 2.5 degree. Consequently, the composite shape control is necessary to obtain a desirable shape and two kinds of shape control means are required for this composite shape control, with its control degree being preferably in a range of 1.8 to 2.5.

Now, speculation is given to errors in the shape control, i.e., defects of the surface shape.

In case of controlling a shape disturbance $x^\beta$ by means of one kind of bender having a degree m, an error after shape correction can be expressed with the following equation:

$$y=x^\beta-ax^m$$

Figure 9:
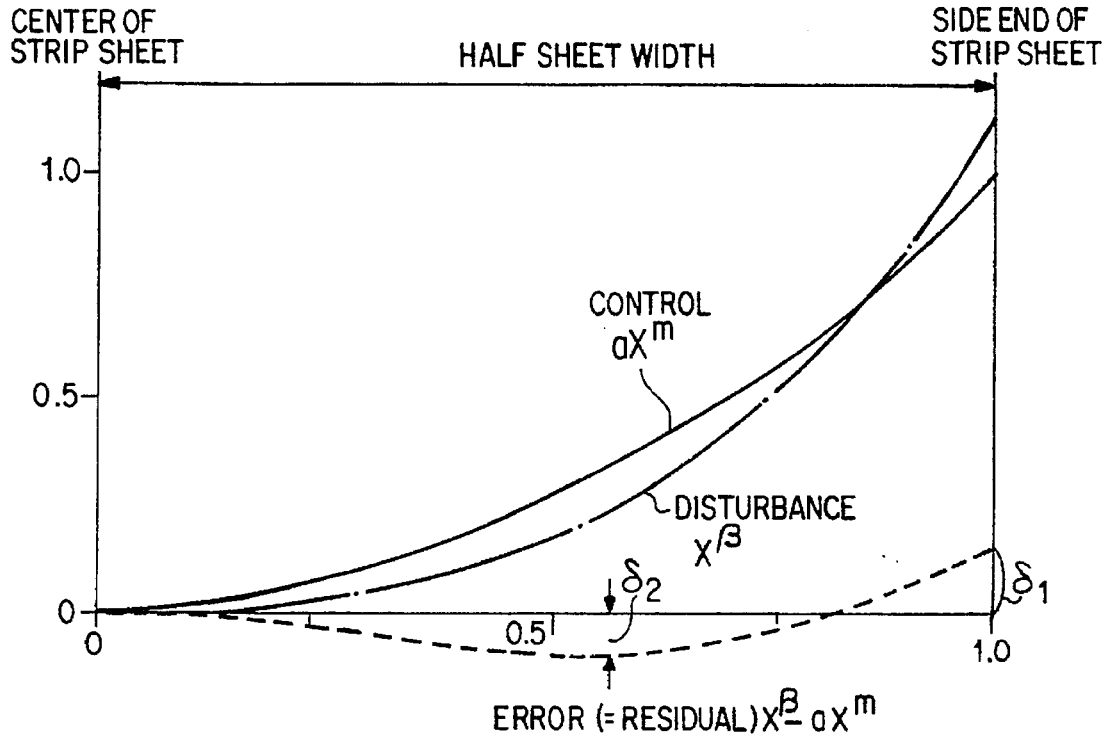
FIGS. 9 and 10 are diagrams showing the characteristics of control errors (defects of the shape) that are controlled by roll bending operations.

In this case although a coefficient a can be changed by force of the bender, the degree m will not be changed. Even if the force of the bender is suitably selected, i.e., even if the coefficient a has an optimum value, the value y will not become zero in the entire width of the strip sheet unless $\beta$ is equal to m, thereby resulting in the error as indicated with a chain line in FIG. 9. This error has two extreme values, and when these extreme values are denoted by $\delta_1$ and $\delta_2$, the maximum value $\delta$ can be derived from the following equation:

$$\delta = \max(\delta_1,\delta_2) = \frac{\beta(m-\beta)}{(m+\beta+1)(\beta+1)} \quad (1)$$

Figure 10:
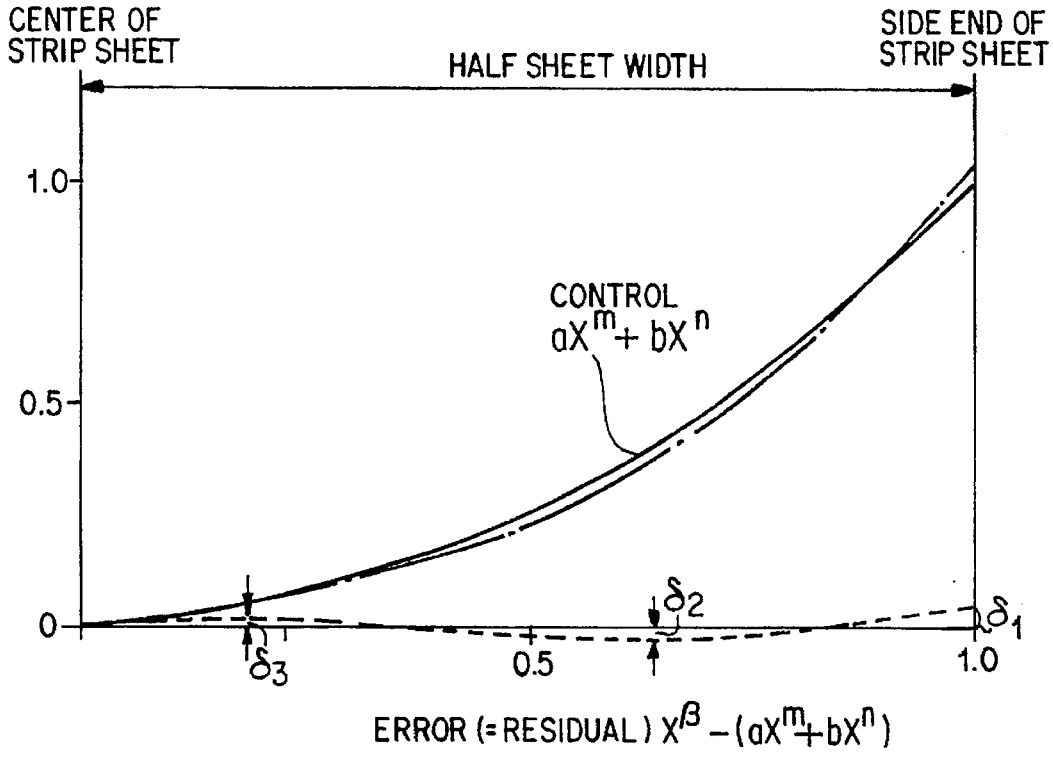

Similarly, in case of controlling the shape disturbance $x^\beta$ by means of two kinds of benders having degrees m and n, an error after shape correction can be expressed with the following equation (as indicated with a dashed line in FIG. 10):

$$y=x^\beta-(ax^m+bx^n)$$

In this case, coefficients a and b can be changed by force of the benders. In the same manner as described above, even if the force of the benders is suitably selected, there remains the error unless $\beta$ is equal to m or $\beta$ is equal to n. This error has three extreme values, and the maximal value $\delta$ can be derived from the following equation:

$$\delta = \max(\delta_1,\delta_2,\delta_3) = \frac{(m-\beta)(n-\beta)}{(m+\beta+1)(n+\beta+1)} \quad (2)$$

It is clearly understood from the equations (1) and (2) that the error in case of the control by two kinds of benders is remarkably smaller than that of the control by one kind of bender. This is numerically shown in Table 2.

TABLE 2

| | Errors in shape control | | | |
|---|---|---|---|---|
| | Degree of | Control Degree | | Shape |
| Case | Disturbance | m | n | defect % |
| 1 | 2 | 1.8 | 2.2 | 0.16 |
| 2 | 2.5 | 1.8 | 2.4 | 0.22 |
| 3 | 2 | 2.2 | — | 2.6 |
| 4 | 2 | 2.8 | — | 10.2 |

For example, when the disturbance of the second degree is controlled by one kind of bender having a degree of 2.2, the error is 2.6%, and when it is controlled by two kinds of benders having degrees of 1.8 and 2.2, the error is drastically reduced to 0.16% (which is 1/16.3 of 2.6%).

Next, there will be considered a case of controlling two kinds of shape disturbances having degrees $\beta_1$ and $\beta_2$ by means of two kinds of benders having degrees m and n. In this case, it is not necessary to control the disturbance with the degree $\beta_1$ by means of the bender with the degree m and control the disturbance with the degree $\beta_2$ by means of the bender with the degree n, but the following steps may be taken. That is to say, the disturbance with the order $\beta_1$ is controlled by the benders with the degrees m and n, and its error is expressed with $\delta_A$. Also, the disturbance with the degree $\beta_2$ is controlled by the same benders with the degrees m and n. Its error is expressed with $\delta_B$. This operation can be carried out when the benders are equipped with the abilities for that purpose.

$$\delta_A=max\{x^{\beta 1}-(a_1m^m+b_1x^n)\} \quad (3)$$

$$\delta_B=max\{x^{\beta 2}-(a_2m^m+b_2x^n)\} \quad (4)$$

In this case, the overall shape defect (i.e., errors) can be expressed with $\delta=\delta_A+\delta_B$, and because each of the errors $\delta_A$ and $\delta_B$ is extremely small, the overall shape defect can be also made very small. In the rolling mill according to the present invention, as described so far, three kinds of benders having control degrees different from one another can perform the control. In the above embodiment, for example, the intermediate roll bender conducts the control with the degree of 1.8; the 6H-side work roll bender conducts the control with the degree of 2.2; and the 4H-side work roll bender conducts the control with the degree of 2.8. Therefore, the composite shape control and the control of the widths of the wrinkled side end portions can be simultaneously effected. It is ideal to perform the composite shape control of strip sheet material by the intermediate roll bender and the 6H-side work roll bender and to control the widths of wrinkled side end portions of the rolled strip sheet by means of the 4H-side work roll bender. Actually, if the 4H-side work roll bender is operated, the shape will be disturbed, and therefore, it will be necessary to slightly change the force of the intermediate roll bender and that of the 6H-side work roll bender. Results of simulations concerning relations between the force of the benders and the shape are shown in Table 3 (below). If the force of the 4H-side work roll bender is changed from −30$ to 100$, it will be understood how much the widths of the non-rolled side end portions of the strip sheet can be changed. In this case, the force of the intermediate roll bender and that of the 6H-side work roll bender are slightly changed not to disturb the shape of the central portion of the strip sheet.

Figure 12:
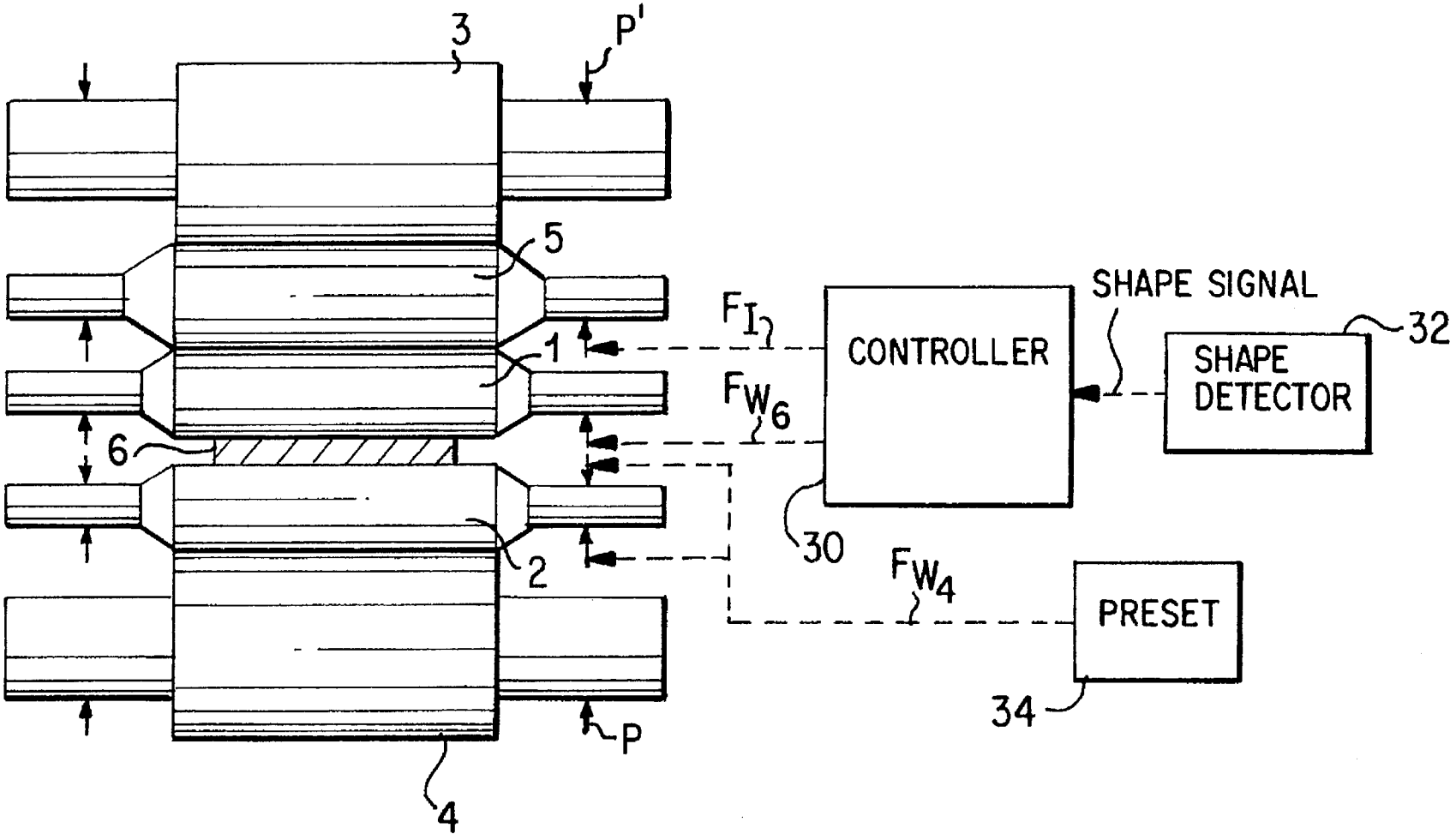
FIG. 12 shows a shape detector and a controller for actuating bending devices of the rolling mill according to the present invention.

Referring to FIG. 12, a controller 30 and a shape detector 32 cooperate to actuate roll bending devices (not shown) which bend the rolls 1–5. A preset unit 34 controls the force $F_{W4}$. The value for $F_{W4}$ can be determined by one of ordinary skill in the art and can, for instance, be one of the values shown in FIG. 13.

The controller 30 of FIG. 12 controls the bending forces $F_I$ and $F_{W6}$. The values of $F_I$ and $F_{W6}$ are set according to the value of a shape signal which is provided by the shape detector 32. The shape detector 32, which measures the shape of the rolled strip sheet, is known to one of ordinary skill in the art. The controller 30 automatically adjusts the values of $F_I$ and $F_{W6}$ according to the deviation of the rolled strip sheet from the desired shape, as indicated by the shape signal. The controller 30 and the shape detector 32 cooperate to bend the rolls of the mill according to the control degrees thereof, as described throughout the present application.

As described so far, the five-high rolling mill according to the present invention makes it possible to reduce the widths of the wrinkled side end portions to a great extent while maintaining the strip sheet in the desirable shape. This has never been accomplished by any conventional five-high rolling mill before.

The point of the invention is that the control degrees m and n differ from each other as much as possible, i.e., it is more preferable that the control degree of the 4H-side work roll bender has a value, for example, from 2.6 to 3.3 at most; the control degree of the intermediate roll bender has a value from 1.7 to 1.9 at least; and the control degree of the 6H-side work roll bender has a value between that of the 4H-side work roll bender and that of the intermediate roll bender, e.g., from 2.0 to 2.4. For establishing this relationship, the intermediate roll is required to have a diameter larger than that of the work rolls. In case the control degrees m has value close to that of the control degree n, the effect will not be much different from that of the control by one kind of bender, thereby causing a large shape defect.

Figure 1:
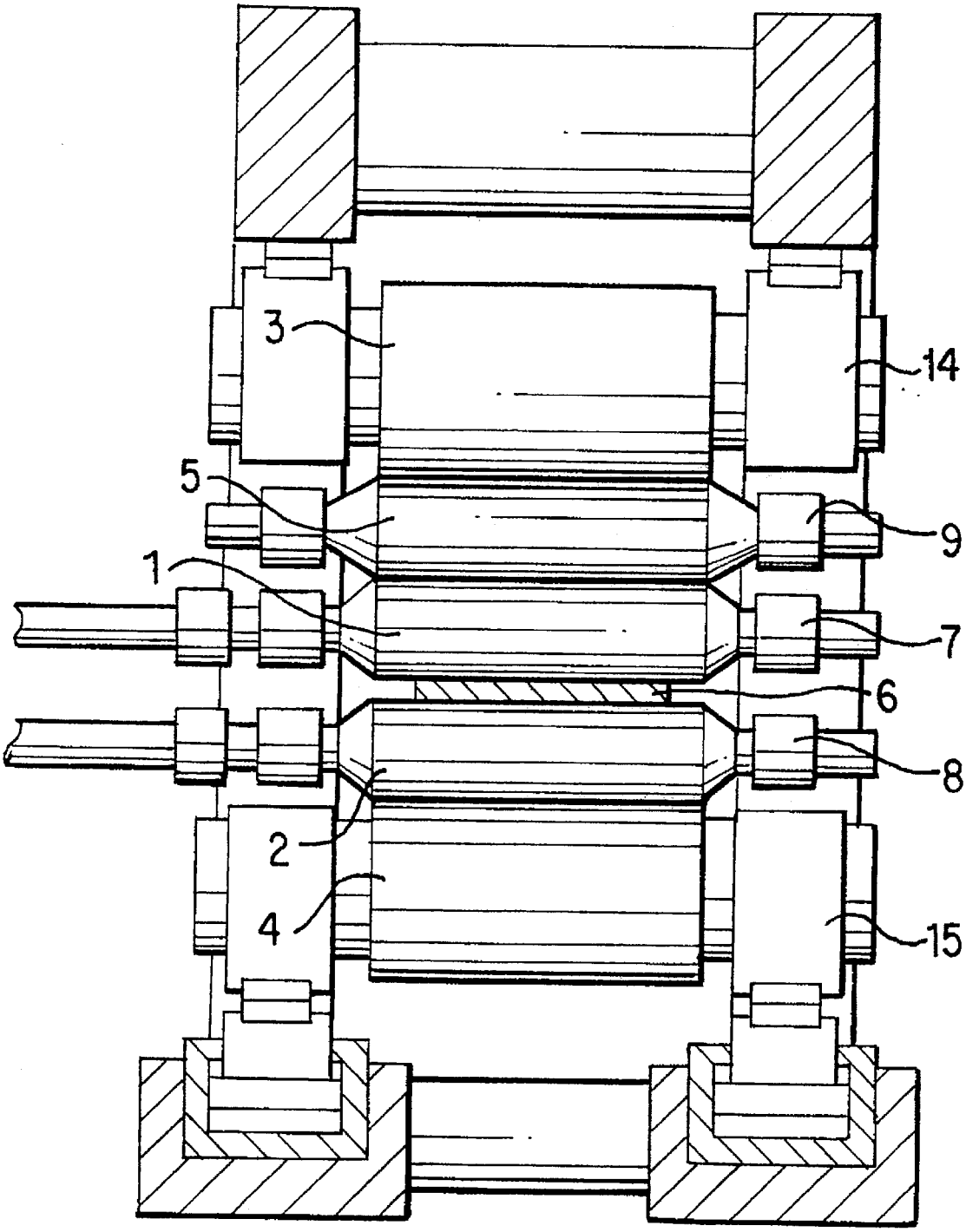
FIG. 1 is a broken-away front view showing a five-high rolling mill according to an embodiment of the present invention.
Figure 2:
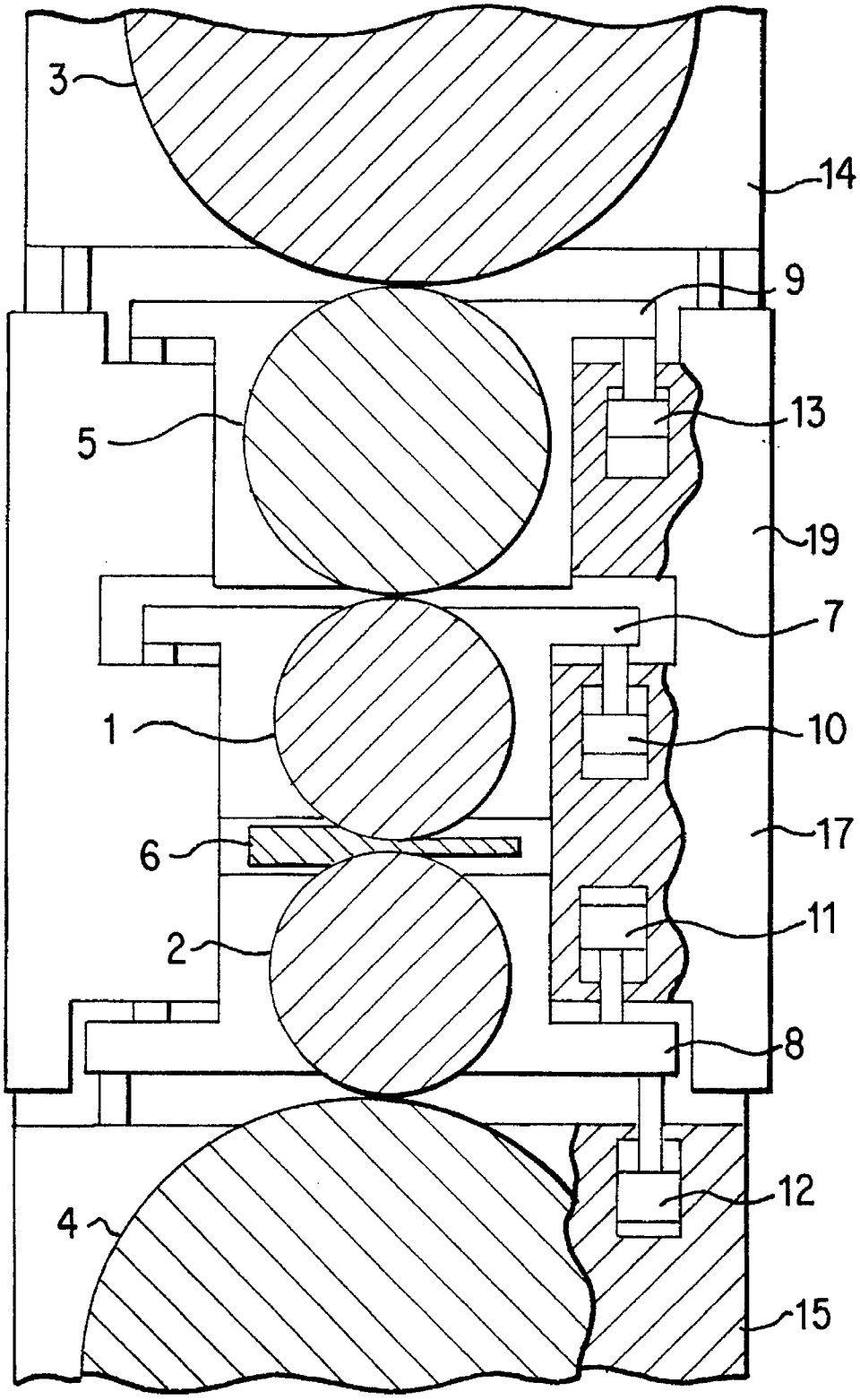
FIG. 2 is a broken-away side view showing the first embodiment of the five-high rolling mill.
Figure 3:
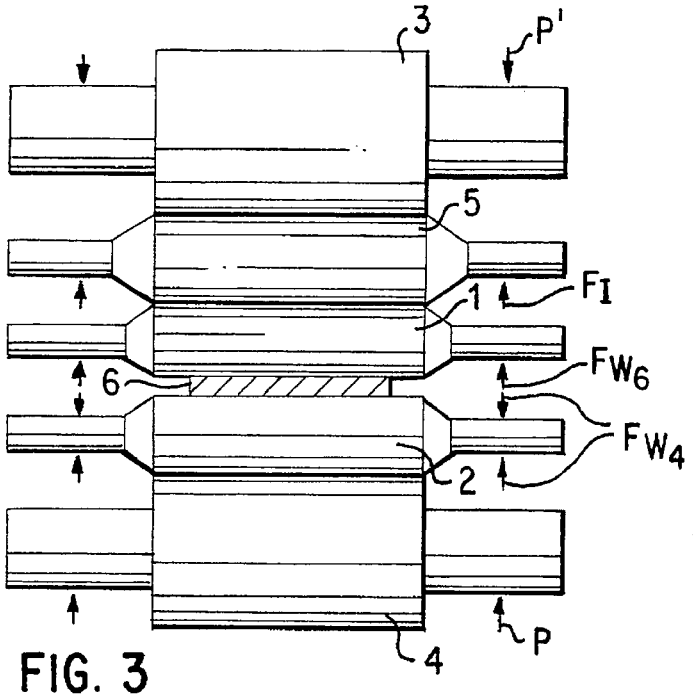
FIG. 3 is a schematical view of this embodiment, showing a condition of effects produced by bending force.

A rolling mill according to one embodiment of the present invention will be hereinafter described with reference to FIGS. 1, 2 and 3. In these drawings, reference numerals 1 and 2 denote upper and lower work rolls which are arranged to have substantially the same diameter. Reference numerals 3 and 4 are upper and lower backup rolls, and reference numeral 5 denotes an intermediate roll which is disposed between one of the work rolls, i.e., the upper work roll 1 and the upper backup roll 3. Increase bending cylinders 10 for the upper work roll 1 are provided in projecting blocks 17 for sustaining bearing boxes 7 of the 6H-side upper work roll 1, respectively. Also, increase bending cylinders 11 and decrease bending cylinders 12 for the lower work roll 2 are provided in the same projecting blocks 17 for sustaining bearing boxes 8 of the lower work roll 2, respectively. These bending cylinders 10, 11 and 12 exert the bending force on the respective bearing boxes 7 and 8 of the upper and lower work rolls 1 and 2 so as to control degrees of bending of the work rolls 1 and 2. As for the intermediate roll 5, bending cylinders 13 provided in projecting blocks 19 for sustaining bearing boxes 9 thereof are arranged to exert the bending force on such bearing boxes 9, thus causing the intermediate roll 5 to be bent.

Since the five-high rolling mill is of the above-described structure, the bending effect of the 6H-side upper work roll 1 only reaches the vicinities of the end portions of the upper work roll 1 due to the existence of the intermediate roll so that the thicknesses of side end portions of strip sheet 6 can be controlled by bending the axis of the work roll 1 in the vicinities of its end portions. Besides, since the bending effect of the intermediate roll 5 covers the roll in its entire length, the sheet thickness over the entire width can be controlled by controlling the axial bending of the intermediate roll in the entire length through the work roll 1. Therefore, the composite shape control of the strip sheet can be achieved by properly combining these two kinds of roll bending effects, thereby enabling the rolling of the strip sheet having an excellent surface quality under the conditions of a small rolling reduction and a small rolling force.

On the other hand, the bending effect of the 4H-side lower work roll 2 does not reach the center of the lower work roll 2, and accordingly, the axial bending of this work roll in its end portions is largely controlled, so that the side end portions of the strip sheet which have not been rolled conventionally can be effectively rolled, thus preventing edge wrinkles from being produced on the side end portions of the strip sheet.

Figure 11:
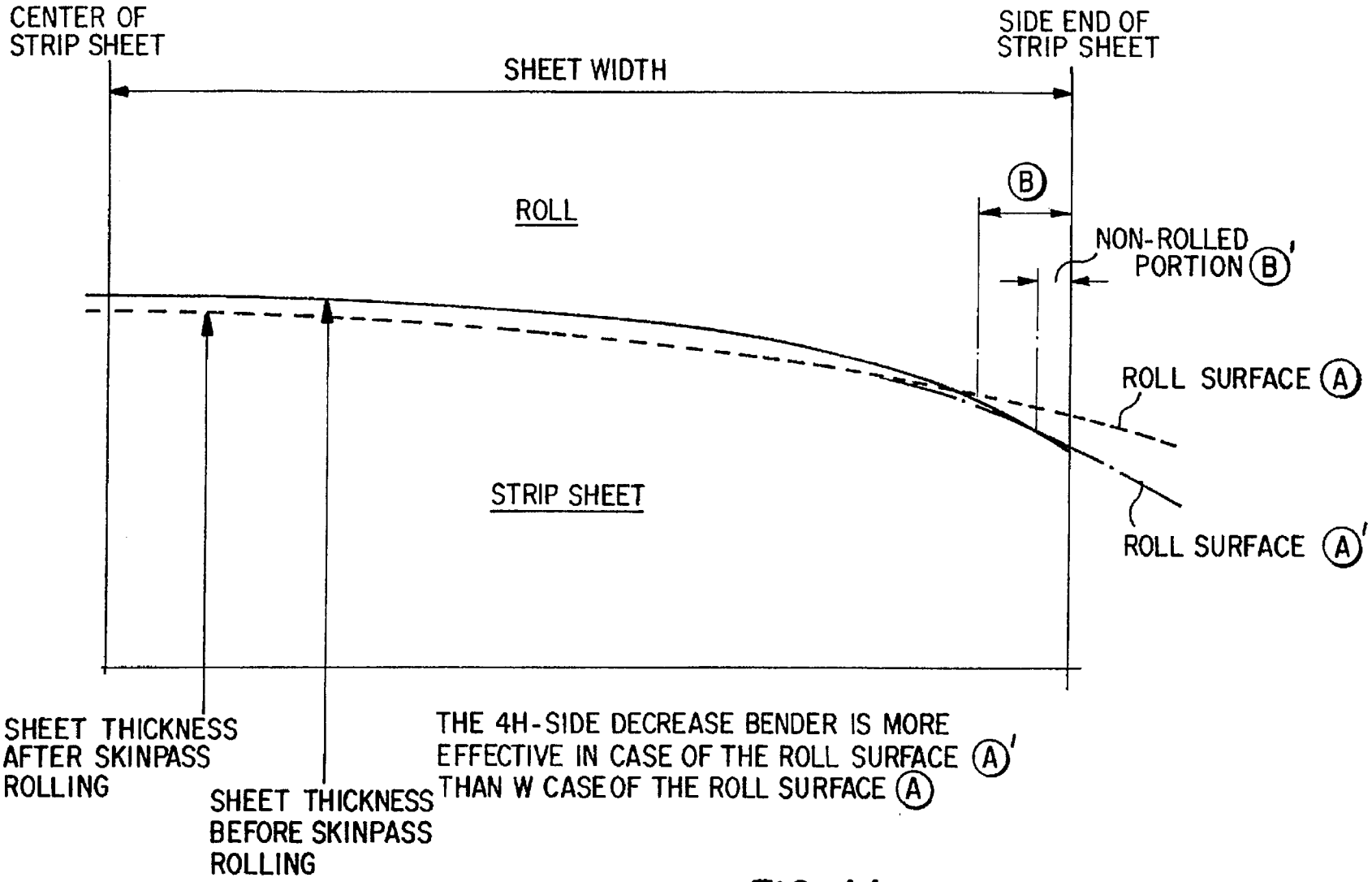
FIG. 11 is a diagram showing a condition of a side end portion of a strip sheet which is not rolled.

Especially, the decrease benders 12 serving as the rolling bending devices provided on the 4H-side work roll 2 cause the side end portions of the work roll 2 to be bent toward the strip sheet 6 and pressed onto the surface of the strip sheet so as to remarkably reduce the non-rolled side end portions of the strip sheet 6, thereby preventing the formation of edge wrinkles (see FIG. 11).

Figure 4:
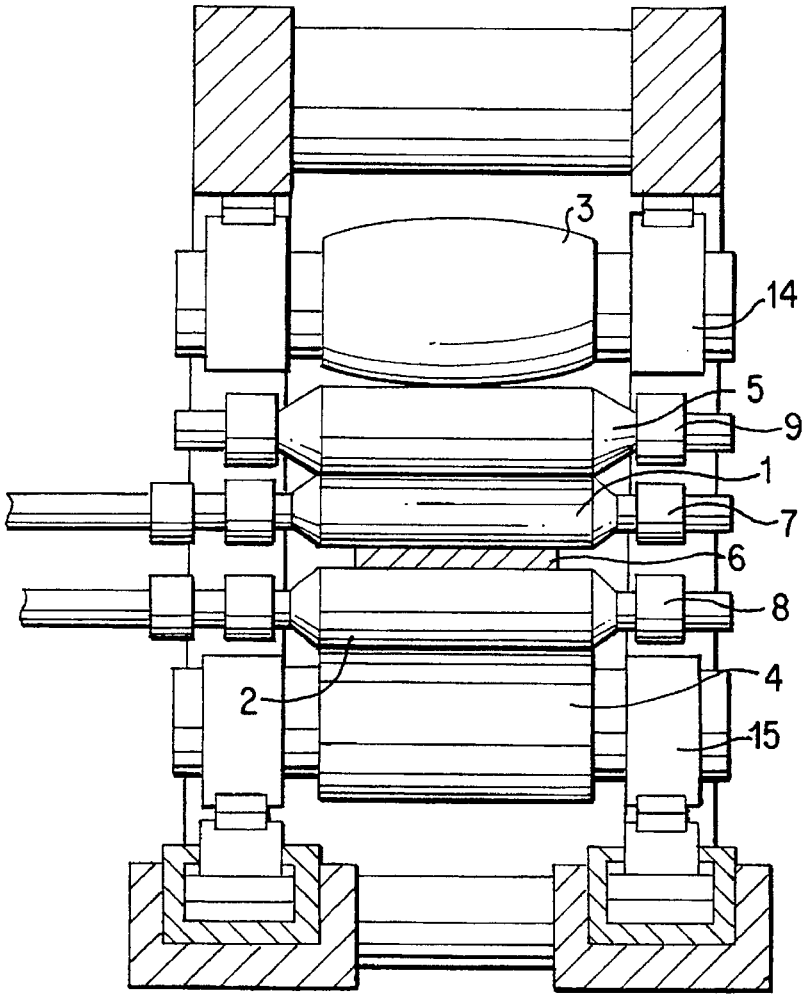
FIG. 4 is a broken-away front view showing a five-high rolling mill according to a different embodiment of the present invention.
Figure 5A:
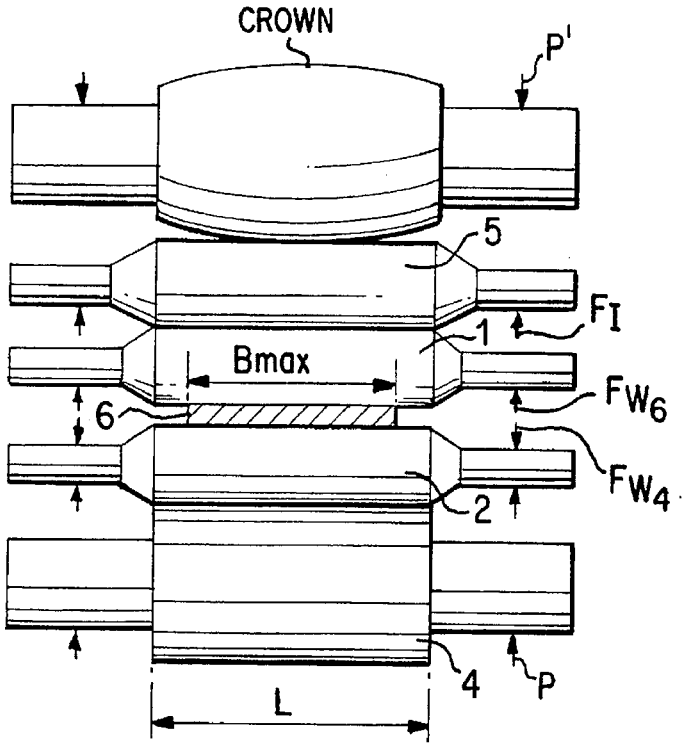
FIGS. 5A and 5B are schematical views showing a five-high rolling mill according to a still other embodiment of the present invention.
Figure 5B:
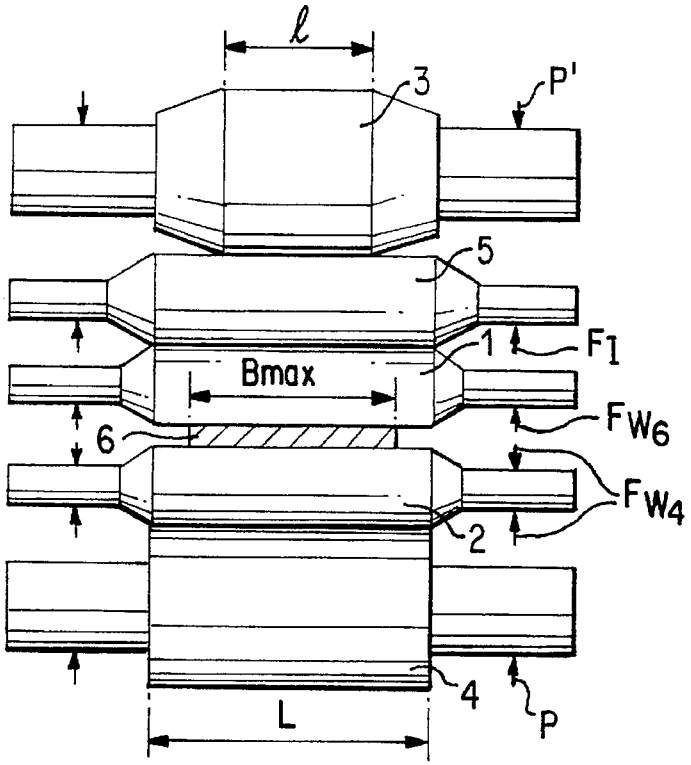

In the above description of the rolling mill, the 6H-side work roll benders 10 and the intermediate roll benders 13 are nothing but increase benders. However, it goes without saying that if the shape is largely disturbed, for example, if the rolling force is large, or if the change of the sheet crown is large, decrease benders in addition to the increase benders are installed for expanding the control range of the bending so as to deal with the shape disturbance mentioned above. Moreover, in order to enhance the effect of the present invention, the effective drum length of the 6H-side backup roll 3 is made smaller than the maximum width of the strip sheet 6, as shown in FIGS. 4, 5A and 5B. In other words, as shown in FIG. 5B, when the effective drum length of the 4H-side backup roll 4 is expressed by L, the maximum sheet width is expressed by $B_{max}$, and the effective drum length of the 6H-side backup roll 3 is expressed by l, they are arranged in a relation $L>B_{max}>l$. Alternatively, as shown in FIG. 5A, when the backup roll 4 is suitably provided with a roll crown of a high degree, the bending effects of the 6H-side work roll 1 and the intermediate roll 5 can be enhanced without changing the control degrees of the work roll 1 and the intermediate roll 5.

When the effective drum length of the 6H-side backup roll is made smaller than that of the intermediate roll, or when the intermediate roll is oscillated by a stroke of ±10 mm or so in case of the five-high rolling mill including the 6H-side backup roll which is provided with a relatively large roll crown when applied to the rolling condition of a large rolling force, defects caused by the shoulders of the backup roll can be prevented from remaining on the strip sheet conveniently.

Furthermore, in case the drum length of the intermediate roll 5 is made larger than the maximum sheet width $B_{max}$ of the strip sheet 6, and the backup roll 3 directly supporting this intermediate roll 5 is formed to be in contact with the intermediate roll 5 over a distance larger than the minimum sheet width $B_{min}$ of the strip sheet and smaller than the maximum sheet width $B_{max}$ of the same, both the bending effects of the work roll and the intermediate roll can be further enlarged without changing the control degrees.

Next, the rolling mill according to the present invention can be also described as follows. That is to say, a multi-high rolling mill is constituted of the upper and lower work rolls 1 and 2 of substantially the same diameter and also a certain number of supporting rolls and a different number of supporting rolls for respectively supporting these work rolls 1 and 2 so that the upper section and the lower section of the rolling mill with respect to the strip sheet includes sets of the rolls in different numbers. The roll bending devices 13 are installed on the supporting roll 5 which directly supports the work roll 1 in the roll set having the larger number of the rolls, and the upper and lower roll sets are arranged to have different control degrees each indicating a degree of change in the sheet crown of the strip sheet which can be controlled by the roll bending devices 13. The roll bending devices 10 and 11 are installed on the respective work rolls 1 and 2 of the upper and lower roll sets in order to vary the control degrees of the sheet crown for the upper and lower work rolls 1 and 2 which can be controlled by the respective roll bending devices 10 and 11, and as for the control orders of these roll bending devices 13, 10 and 11, the supporting roll 5 in one of the roll sets having the larger number of the rolls, the work roll 1 in this roll set, and the work roll 2 in the other roll set having the smaller number of the rolls are controlled with the control degree of values gradually increasing in this order.

As shown in Table 1, seeing that the control degree of the roll bending devices for the supporting roll 5 in the one roll set having the larger number of the rolls has a value which is set close to and not more than 2, e.g., 1.8; that of the devices for the work roll 1 in this roll set has a value which is set close to and not less than 2, e.g., 2.2; and that of the devices for the work roll 2 in the other roll set having the smaller number of the rolls has a value which is set close to and not more than 3, e.g., 2.8, the rolling mill of the invention significantly requires including three kinds of control means which have control orders different from one another.

Figure 6:
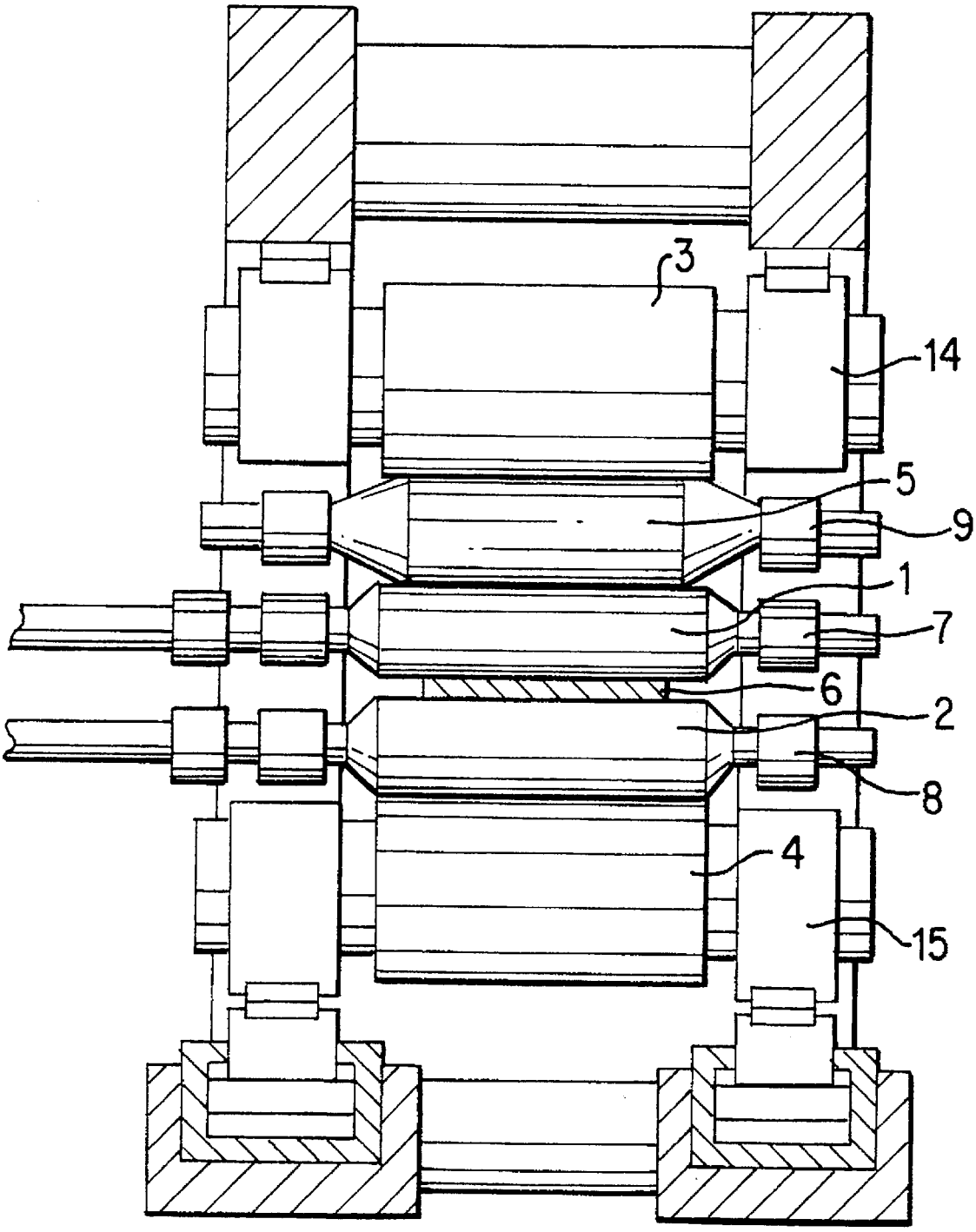
FIGS. 6 and 7 are a broken-away front view and a schematical view showing a five-high rolling mill according to a further embodiment of the present invention.
Figure 7:
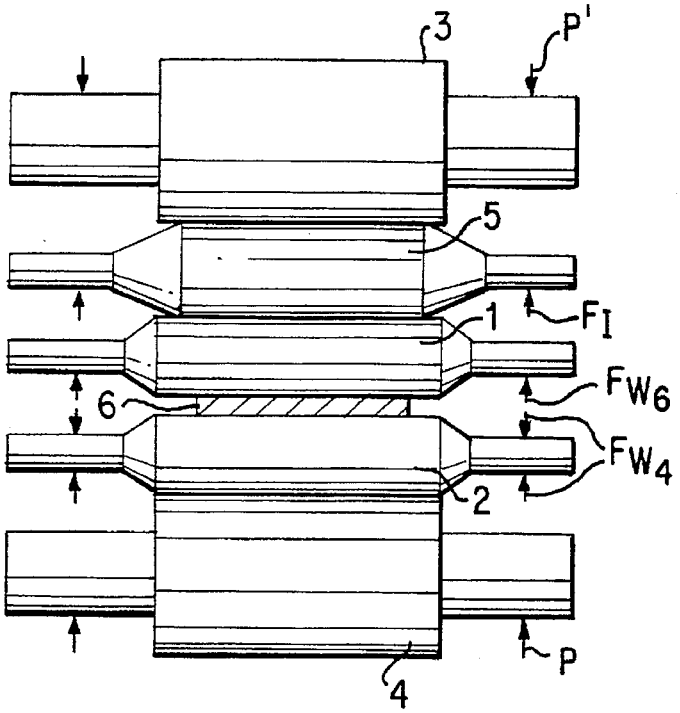

Another embodiment for enhancing the roll bending effects of the rolling mill according to the present invention is shown in FIGS. 6 and 7, in which the drum length of the 6H-side intermediate roll 5 is made as small as possible in a range larger than the maximum sheet width of the strip sheet 6. That is to say, when the intermediate roll 5 has a small drum length, the end portions thereof are not in contact with the backup roll 3 of a large diameter, and consequently, not only the effect of the benders for the 6H-side intermediate roll 5 but also the effect of the benders for the upper work roll 1 is enhanced. The reason why the drum length of the intermediate roll is larger than the maximum sheet width in this embodiment is that if the drum length of the intermediate roll is smaller than the maximum sheet width, the surface roughness of a portion of the work roll which is in contact with the intermediate roll will differ from that of a portion of the work roll which is not in contact with it, and as a result, the roughness of the sheet surface will be varied, thus damaging the surface quality of the strip sheet. This is particularly noticeable when the work roll is a dull roll.

In this manner, the five-high rolling mill of the present invention is exquisitely equipped with both the characteristic of a six-high rolling mill that the roll bending effect is apt to reach the center of the strip sheet and the characteristic of a four-high rolling mill that the roll bending effect is apt to be produced on the side end portions of the strip sheet. Thus, there can be provided the multi-high rolling mill which is capable of multiple bending control of the work rolls, efficient control of the shape of the strip sheet, and preventing the formation of edge wrinkles.

A rolling method of the multi-high rolling mill according to the present invention will be described hereinbelow.

In this rolling method, there is employed the multi-high rolling mill including the upper and lower work rolls 1 and 2 of substantially the same diameter, the upper and lower backup rolls 3 and 4 supporting those work rolls 1 and 2, respectively, and the intermediate roll 5 located between one of the upper and lower work rolls 1, 2 and the associated backup roll 3, 4. The roll bending devices 13 installed on the intermediate roll 5 and the roll bending devices 10 installed on the work roll in the roll set where the intermediate roll is disposed are both actuated to control the composite sheet crown of the strip sheet 6 in its entire width, and the roll bending devices 11 which are installed on the other work roll directly supported by the associated backup roll are actuated to control the sheet crown of the side end portions of the strip sheet 6. In this manner, the rolling method is arranged to perform both the composite shape control of the strip sheet and the control of the widths of the non-rolled side end portions of the strip sheet. Therefore, by properly combining the effects of the bending operations which have control characteristics different from each other, i.e., the effect of bending the intermediate roll which enables the bending control over the entire length of the roll and the effect of bending the work roll in the roll set where the intermediate roll is disposed which enables the bending control of the vicinities of the roll end portions, the sheet thickness in the entire width can be desirably controlled and thus, it is possible to provide the rolling method which can effect the composite shape control of the strip sheet even when the rolling operation is performed under the condition of a small rolling reduction. In addition, due to the bending effect of the work roll directly supported by the associated backup roll, the end portions of this work roll are largely bent to effectively control the thickness of the side end portions of the strip sheet 6 and reduce the widths of the non-rolled portions, and consequently, it is possible to provide the rolling method which can sufficiently prevent edge wrinkles from forming on the side end portions of the strip sheet.

Although the above description relates to the skinpass rolling mill, it should be noted that when the rolling mill of the present invention is applied as a rolling mill of a small rolling force for materials other than iron, such as copper and aluminum, it is effective for performing composite shape control covering a wide range.

The present invention can provide a rolling mill which has an excellent ability in the composite shape control for remarkably improving the surface quality of the strip sheet and which reduces the non rolled portions in the vicinities of the sheet side ends for preventing the formation of edge wrinkles, thereby producing a great effect.

What is claimed:

1. A five-high rolling mill comprising:

first and second work rolls facing one another to form a sheet rolling region therebetween for rolling sheet material;

an intermediate roll supportably engaging the first work roll, said intermediate roll having a diameter greater than the diameter of either of said work rolls;

a first backup roll supportably engaging the intermediate roll;

a second backup roll supportably engaging the second work roll;

a first roll control bending device for applying bending forces to the first work roll;

a second roll control bending device for applying bending forces to the intermediate roll;

a third roll control bending device for applying bending forces to the second work roll;

wherein said first and second roll control bending devices are configured to apply respective first and second different control degrees to thereby provide composite shape control to a strip of sheet material being rolled in the sheet rolling region;

wherein said third roll control bending device is configured to apply a third different control degree to said second work roll to minimize the production of wrinkled edge portions in a strip of sheet material being rolled;

and control means operably controlling bending forces applied by each of the first, second and third control bending devices so that said first and second roll control bending devices apply respective first and second different control degrees to control a composite sheet crown of the rolled material over an entire width of the rolled material to thereby control thickness of the rolled material over its entire width; and so that said third roll control bending device applies a third different control degree to said second work roll to control sheet crown of the rolled material at lateral side end portions of the rolled material to thereby prevent edge wrinkles in said side end portions.

2. A five-high rolling mill according to claim 1, wherein said first and second work rolls have substantially the same diameter.

3. A five-high rolling mill according to claim 2, wherein said work rolls have a diameter that is no less than 450 mm.

4. A five-high rolling mill according to claim 1, wherein said intermediate roll has a longer length than a predetermined maximum sheet width of a strip of sheet material being rolled.

5. A five-high rolling mill according to claim 4, wherein the first backup roll is disposed 180 degrees from said second work roll and is in contact with said intermediate roll over a distance less than the length of said intermediate roll.

6. A five-high rolling mill according to claim 5, wherein the first backup roll is in contact with said intermediate roll over a distance less than a predetermined maximum sheet width of a strip of sheet material to be rolled and greater than a predetermined minimum sheet width of a strip of sheet material to be rolled.

7. A five-high rolling mill according to claim 6, wherein said third roll control bending device is configured to apply decrease bending forces to ends of said second work roll in a direction toward a plane of said strip of sheet material being rolled.

8. A five-high rolling mill according to claim 7, wherein said second roll control bending device is configured to apply increase bending forces to ends of said intermediate roll in a direction away from the plane of said strip of sheet material being rolled.

9. A five-high rolling mill according to claim 8, wherein said control means includes means for individually actuating the roll control bending devices.

10. A five-high rolling mill according to claim 1, wherein said first roll control bending device is configured to apply increase bending forces to ends of said first work roll in a direction away from a plane of said strip of sheet material being rolled.

11. A five-high rolling mill according to claim 1, wherein said first and second roll control bending devices are configured to also provide decrease bending forces to said second work roll and said intermediate roll, respectively.

12. A five-high rolling mill according to claim 1, wherein said control means includes means for individually actuating the roll control bending devices.

13. A five-high rolling mill according to claim 1, wherein the degree of control associated with said second work roll is 2.8.

14. A five-high rolling mill according to claim 1, wherein the degree of control associated with said first work roll is 2.2.

15. A five-high rolling mill according to claim 1, wherein the degree of control associated with said intermediate roll is 1.8.

16. A five-high rolling mill according to claim 1, further comprising:

a shape detector, for providing a signal indicative of a sensed shape of the sheet material being rolled;

said control means being responsive to the signal provided by said shape detector for actuating said roll control bending devices according to the detected shape of sheet material rolled through the mill.

17. A five-high rolling mill according to claim 16, wherein said first and second work rolls have substantially the same diameter and said intermediate roll has a diameter greater than said work rolls.

18. A five-high rolling mill according to claim 17, wherein said work rolls have a diameter that is no less than 450 mm.

19. A five-high rolling mill according to claim 18, wherein said control means includes means for individually actuating the roll control bending devices.

20. A five-high rolling mill according to claim 16, wherein said intermediate roll has a longer length than a predetermined maximum sheet width of a strip of sheet material to be rolled.

21. A five-high rolling mill according to claim 20, wherein the first backup roll is disposed 180 degrees from said second work roll and is in contact with said intermediate roll over a distance less than the length of said intermediate roll.

22. A five-high rolling mill according to claim 16, wherein said control means includes means for individually actuating the roll control bending devices.

23. A five-high rolling mill according to claim 1, wherein said third roll control bending device is configured to apply decrease bending forces to ends of said second work roll in a direction toward a plane of said strip of sheet material being rolled.

24. A five-high rolling mill comprising:

first and second work rolls facing one another to form a sheet rolling region therebetween for rolling sheet material;

an intermediate roll supportably engaging the first work roll;

a first backup roll supportably engaging the intermediate roll;

a second backup roll supportably engaging the second work roll;

first roll control bending means for applying bending forces to the first work roll;

second roll control bending means for applying bending forces to the intermediate roll;

third roll control bending means for applying bending forces to the second work roll;

and control means operably controlling bending forces applied by each of the first, second and third control bending means so that said first and second roll control bending means apply respective first and second different control degrees to control a composite sheet crown of the rolled material over an entire width of the rolled material to thereby control thickness of the rolled material over its entire width; and so that said third roll control bending means applies a third different control degree to said second work roll to control sheet crown of the rolled material at lateral side end portions of the rolled material to thereby prevent edge wrinkles in said side end portions.

25. A five-high rolling mill according to claim 24, wherein said control means includes means for controlling the third roll control bending means so as to apply decrease bending forces to ends of said second work roll in a direction toward a plane of said strip of material being rolled.

26. A five-high rolling mill according to claim 24, wherein said intermediate roll has a longer length than a predetermined maximum sheet width of a strip of sheet material being rolled;

wherein the first backup roll is disposed 180 degrees from said second work roll and is in contact with said intermediate roll over a distance less than the length of said intermediate roll; and wherein the first backup roll is in contact with said intermediate roll over a distance less than a predetermined maximum sheet width of a strip of sheet material to be rolled and greater than a predetermined minimum sheet width of a strip of sheet material to be rolled.

27. A five-high rolling mill according to claim 26, wherein said control means includes means for controlling the third roll control bending means so as to apply decrease bending forces to ends of said second work roll in a direction toward a plane of said strip of material being rolled.

28. A five-high rolling mill according to claim 27, wherein said first roll control bending means is configured to apply increase bending forces to ends of said first work roll in a direction away from a plane of said strip of sheet material being rolled.

* * * * *